US009215541B2

(12) United States Patent
Li

(10) Patent No.: US 9,215,541 B2
(45) Date of Patent: Dec. 15, 2015

(54) APPARATUS FOR DETECTING TYPE OF AUDIO INTERFACE

(71) Applicant: Tendyron Corporation, Beijing (CN)

(72) Inventor: Dongsheng Li, Beijing (CN)

(73) Assignee: Tendyron Corporation (CN)

( * ) Notice: Subject to any disclaimer, the term of this patent is extended or adjusted under 35 U.S.C. 154(b) by 0 days.

(21) Appl. No.: 14/372,785

(22) PCT Filed: Dec. 28, 2012

(86) PCT No.: PCT/CN2012/087919

§ 371 (c)(1),
(2) Date: Jul. 17, 2014

(87) PCT Pub. No.: WO2013/107272

PCT Pub. Date: Jul. 25, 2013

(65) Prior Publication Data

US 2015/0016619 A1 Jan. 15, 2015

(30) Foreign Application Priority Data

Jan. 20, 2012 (CN) ..... 2012 1 0018956

(51) Int. Cl.
*H04R 29/00* (2006.01)
*H04R 5/04* (2006.01)

(52) U.S. Cl.
CPC ..... *H04R 29/00* (2013.01); *H04R 5/04* (2013.01); *H04R 2420/03* (2013.01); *H04R 2420/05* (2013.01)

(58) Field of Classification Search
CPC .... H01R 13/71; H01R 13/641; H01R 13/703; H01R 2201/20; H04R 5/04; H04R 29/00; H04R 2420/03; H04R 2420/05; H04M 1/60; G01R 31/02; G01R 31/04; G01R 31/021; G01R 31/024; G01R 31/025; G01R 31/046; G01R 31/2832
USPC ..... 381/58; 439/488
See application file for complete search history.

(56) References Cited

U.S. PATENT DOCUMENTS 7,912,501 B2 * 3/2011 Johnson et al. ..... 455/556.1
8,180,397 B2 * 5/2012 Stenmark et al. ..... 455/557

(Continued)

FOREIGN PATENT DOCUMENTS

CN 101179871 A 5/2008
CN 101686282 A 3/2010
CN 102056072 A 5/2011
CN 102300003 A 12/2011

OTHER PUBLICATIONS

International Search Report for Application No. PCT/CN2012/087919 dated Apr. 11, 2013.

*Primary Examiner* — Davetta W Goins
*Assistant Examiner* — Oyesola C Ojo
(74) *Attorney, Agent, or Firm* — Lerner, David, Littenberg, Krumholz & Mentlik, LLP

(57) ABSTRACT

An apparatus for detecting a type of an audio interface is disclosed. The apparatus comprises: an audio interface, comprising a pin 3 and a pin 4, in which one of the pin 3 and the pin 4 is configured as a MIC pin of the audio interface, and the other one is configured as a ground pin; a first level comparison module configured to output a signal Sg1, when a level V3 of the pin 3 is greater than a sum of a level V4 of the pin 4 and a predetermined threshold Vg1, otherwise to output a signal Sg1'; a second level comparison module configured to output a signal Sg2, when the level V4 of the pin 4 is greater than a sum of the level V3 of the pin 3 and a predetermined threshold Vg2, otherwise to output a signal Sg2'.

21 Claims, 4 Drawing Sheets

(56) References Cited

U.S. PATENT DOCUMENTS 8,243,945 B2 * 8/2012 Li ..... 381/74
8,798,674 B2 * 8/2014 Kim et al. ..... 455/556.1
2004/0081099 A1 * 4/2004 Patterson et al. ..... 370/241
2011/0099298 A1 * 4/2011 Chadbourne et al. ..... 710/10

* cited by examiner

APPARATUS FOR DETECTING TYPE OF AUDIO INTERFACE

CROSS-REFERENCE TO RELATED APPLICATIONS

The present application is a national phase entry under 35 U.S.C. § 371 of International Application No. PCT/CN2012/087919 filed Dec. 28, 2012, published in English as WO 2013/107272, which claims priority from Chinese Patent Application No. 201210018956.5 filed Jan. 20, 2012, all of which are hereby incorporated herein by reference.

FIELD

The present invention generally relates to an electronic technique field, and more particularly relates to an apparatus for detecting a type of an audio interface.

BACKGROUND

An audio interface (such as a headphone socket) of an existing audio signal sending device (such as a mobile communication terminal) and an audio interface of an existing audio signal receiving device (such as a headphone) generally use a four-section interface, in which a pin 1 and a pin 2 are audio pins, i.e., a left-channel pin and a right-channel pin respectively. However, a pin 3 and a pin 4 of different types of audio interfaces play different roles, that is, there are two types of audio interfaces: the pin 3 is a MIC pin (a microphone pin) and the pin 4 is a GND pin (a ground pin); the pin 3 is a GND pin and the pin 4 is a MIC pin.

As different types of audio interfaces exist, if the audio interface of the audio signal sending device (such as the mobile communication terminal) and the audio interface of the audio signal receiving device (such as the headphone, a headset) do not match, the audio signal sending device can neither communicate with the audio signal receiving device via the MIC pin of the audio interface, nor transmit an audio signal to the audio signal receiving device via the audio pins (i.e., the left-channel pin and the right-channel pin) of the audio interface normally.

Therefore, whether for designing the audio signal receiving device (such as the headphone, a headset, a loudspeaker, an audio signal adapter device, and other audio signal receiving devices for receiving and processing the audio signal via the audio pins) which may be correctly adapted to the audio signal sending devices (such as the mobile communication terminal) with different types of audio interfaces, or for prompting a user whether the audio interface is matched with the audio signal receiving device with a voice or text prompting function, first of all, it is required to detect the type of the audio interface in the audio signal receiving device so as to detect the type of the audio interface of the audio signal sending device (such as the mobile communication terminal) currently connected with the audio signal receiving device.

SUMMARY

The present disclosure overcomes the defects of the prior art, and provides an apparatus (a circuit) for detecting a type of an audio interface so as to detect and identify the type of the audio interface of an audio device connected with the apparatus.

the present disclosure provides an apparatus for detecting a type of an audio interface, comprising: an audio interface, comprising a pin 3 and a pin 4, wherein one of the pin 3 and the pin 4 is configured as a MIC pin of the audio interface, and the other one is configured as a ground pin; a first level comparison module, connected with the pin 3 and the pin 4, and configured to output a signal Sg1 via an output end of the first level comparison module, when a level V3 of the pin 3 is greater than a sum of a level V4 of the pin 4 and a predetermined threshold Vg1, otherwise to output a signal Sg1' via the output end of the first level comparison module; a second level comparison module, connected with the pin 3 and the pin 4, and configured to output a signal Sg2 via an output end of the second level comparison module, when the level V4 of the pin 4 is greater than a sum of the level V3 of the pin 3 and a predetermined threshold Vg2, otherwise to output a signal Sg2' via the output end of the second level comparison module; wherein the signal Sg1 is different from the signal Sg1', the signal Sg2 is different from the signal Sg2', and the predetermined threshold Vg1 and the predetermined threshold Vg2 are greater than or equal to 0.

Furthermore, the signal Sg1 is a high level signal, the signal Sg1' is a low level signal; or the signal Sg1 is a low level signal, the signal Sg1' is a high level signal; and the signal Sg2 is a high level signal, the signal Sg2' is a low level signal; or the signal Sg2 is a low level signal, the signal Sg2' is a high level signal.

Furthermore, the first level comparison module comprises: an NPN-type triode Ta and a output end of a first power supply; a base of the NPN-type triode Ta is connected with the pin 4, an emitter of the NPN-type triode Ta is connected with the pin 3, and a collector of the NPN-type triode Ta is connected with the output end of the first level comparison module and the output end of the first power supply; the second level comparison module comprises: an NPN-type triode Tb and a output end of a second power supply; a base of the NPN-type triode Tb isconnected with the pin 3, an emitter of the NPN-type triode Tb is connected with the pin 4, and a collector of the NPN-type triode Tb is connected with the output end of the second level comparison module and the output end of the second power supply.

Furthermore, the first level comparison module comprises: a first reference voltage module H1 and a comparator C1; the pin 3 is connected with a positive terminal of the comparator C1, the pin 4 is connected with a negative terminal of the first reference voltage module H1, and a positive terminal of the first reference voltage module H1 is connected with a negative terminal of the comparator C1; the second level comparison module comprises: a second reference voltage module H2 and a comparator C2; the pin 3 is connected with a negative terminal of the comparator C2, the pin 4 is connected with a positive terminal of the second reference voltage module H2, and a negative terminal of the second reference voltage module H2 is connected with a positive terminal of the comparator C2.

Furthermore, the first level comparison module comprises: the first reference voltage module H1 and the comparator C1; the pin 4 is connected with the positive terminal of the comparator C1, the pin 3 is connected with the negative terminal of the first reference voltage module H1, and the positive terminal of the first reference voltage module H1 is connected with the negative terminal of the comparator C1; the pin 4 is connected with the negative terminal of the comparator C2, the pin 3 is connected with the positive terminal of the second reference voltage module H2, and the negative terminal of the second reference voltage module H2 is connected with the positive terminal of the comparator C2.

Furthermore, the first level comparison module comprises: the NPN-type triode Ta and the output end of the first power supply; the base of the NPN-type triode Ta is connected with the pin 4, the emitter of the NPN-type triode Ta is connected with the pin 3, and the collector of the NPN-type triode Ta is connected with the output end of the first level comparison module and the output end of the first power supply; the second level comparison module comprises: the second reference voltage module H2 and the comparator C2; the pin 3 is connected with the positive terminal of the comparator C2, the pin 4 is connected with the negative terminal of the second reference voltage module H2, and the positive terminal of the second reference voltage module H2 is connected with the negative terminal of the comparator C2.

Furthermore, the first level comparison module comprises: the first reference voltage module H1 and the comparator C1; the pin 3 is connected with the negative terminal of the comparator C1, the pin 4 is connected with the positive terminal of the first reference voltage module H1, and the negative terminal of the first reference voltage module H1 is connected with the positive terminal of the comparator C1; the second level comparison module comprises: the NPN-type triode Tb and the output end of the second power supply; the base of the NPN-type triode Tb is connected with the pin 3, the emitter of the NPN-type triode Tb is connected with the pin 4, and the collector of the NPN-type triode Tb is connected with the output end of the second level comparison module and the output end of the second power supply.

Furthermore, the apparatus further comprises a resistor R3*a*, and the output end of the first power supply is connected with the collector of the NPN-type triode Ta and the output end of the first level comparison module via the resistor R3*a*.

Furthermore, the apparatus further comprises a resistor R1*a* and a resistor R2*a*, the pin 4 is connected with the base of the NPN-type triode Ta via the resistor R1*a*, the output end of the first level comparison module is connected with the collector of the NPN-type triode Ta via the resistor R2*a*, the collector of the NPN-type triode Ta is connected with the output end of the first power supply via the resistor R2*a* and the resistor R3*a* sequentially; and/or the apparatus further comprises a resistor R4*a*, the pin 3 is connected with the emitter of the NPN-type triode Ta via the resistor R4*a*.

Furthermore, the apparatus further comprises a resistor R3*b*, and the output end of the second power supply is connected with the collector of the NPN-type triode Tb and the output end of the second level comparison module via the resistor R3*b*.

Furthermore, the apparatus further comprises a resistor R1*b* and a resistor R2*b*, the pin 3 is connected with the base of the NPN-type triode Tb via the resistor R1*b*, the output end of the second level comparison module is connected with the collector of the NPN-type triode Tb via the resistor R2*b*, the collector of the NPN-type triode Tb is connected with the output end of the second power supply via the resistor R2*b* and the resistor R3*b* sequentially; and/or the apparatus further comprises a resistor R4*b*, the pin 4 is connected with the emitter of the NPN-type triode Tb via the resistor R4*b*.

Furthermore, the audio interface is a headphone jack or a headphone socket.

In conclusion, the apparatus for detecting the type of the audio interface according to embodiments of the present disclosure may accurately judge the type of the audio interface with a low cost, when the audio device connected with the apparatus detects or uses a MIC pin of the audio interface (that is, provides a bias voltage to the MIC pin).

BRIEF DESCRIPTION OF THE DRAWINGS

In order to explicitly illustrate a technical solution of embodiments of the present disclosure, a brief introduction for the accompanying drawings corresponding to the embodiments will be listed as follows. Apparently, the drawings described below are only corresponding to some embodiments of the present disclosure, and those skilled in the art may obtain other drawings according to these drawings without creative labour.

DETAILED DESCRIPTION

The present disclosure will be described below in detail with reference to drawings and embodiments. Apparently, the described embodiments are only a part of embodiments of the present disclosure rather than the whole embodiments. All other embodiments obtained by those skilled in the art based on the described embodiments fall into the scope of the present disclosure.

Figure 1:
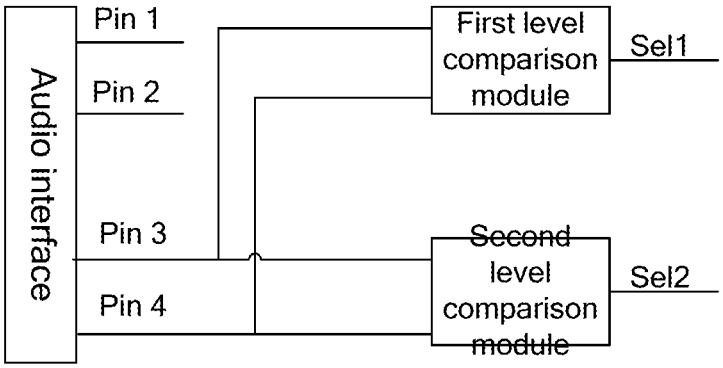
FIG. 1 is a schematic principle diagram of an apparatus for detecting a type of an audio interface according to embodiments of the present disclosure.

As shown in FIG. 1, the key point of the present disclosure comprises:

providing two level comparison modules in an apparatus for detecting a type of an audio interface: a first level comparison module and a second level comparison module;

connecting a pin 3 and a pin 4 of the audio interface with the first level comparison module, outputting a corresponding indication signal (denoted as Sg1) at an output end (Sel1) of the first level comparison module, when a level V3 of the pin 3 is greater than a sum of a level V4 of the pin 4 and a predetermined threshold Vg (i.e., V3>V4+Vg); and connecting the pin 3 and the pin 4 of the audio interface with the second level comparison module, outputting a corresponding indication signal (denoted as Sg2) at an output end (Sel2) of the second level comparison module, when the level V4 of the pin 4 is greater than a sum of the level V3 of the pin 3 and the predetermined threshold Vg (i.e., V4>V3+Vg).

Vg is greater than or equal to 0.

According to the indication signals output from the two level comparison modules of the apparatus for detecting the type of the audio interface, it is possible to accurately judge which of the pin 3 and the pin 4 is a GND pin and which is a MIC pin, that is, when the first level comparison module outputs the indication signal Sg1 (such as a low level signal), it is judged that the pin 4 is the GND pin and the pin 3 is the MIC pin; when the second level comparison module outputs the indication signal Sg2 (such as a low level signal), it is judged that the pin 3 is the GND pin and the pin 4 is the MIC pin.

When an output signal of the first level comparison module is not the indication signal Sg1 (such as a high level signal), and an output signal of the second level comparison module is not the indication signal Sg2 (such as a high level signal), it is indicated that the type of the current audio interface is undermined.

The present disclosure will be described in detail with reference to drawings and embodiments as follows.

First Embodiment

Figure 2:
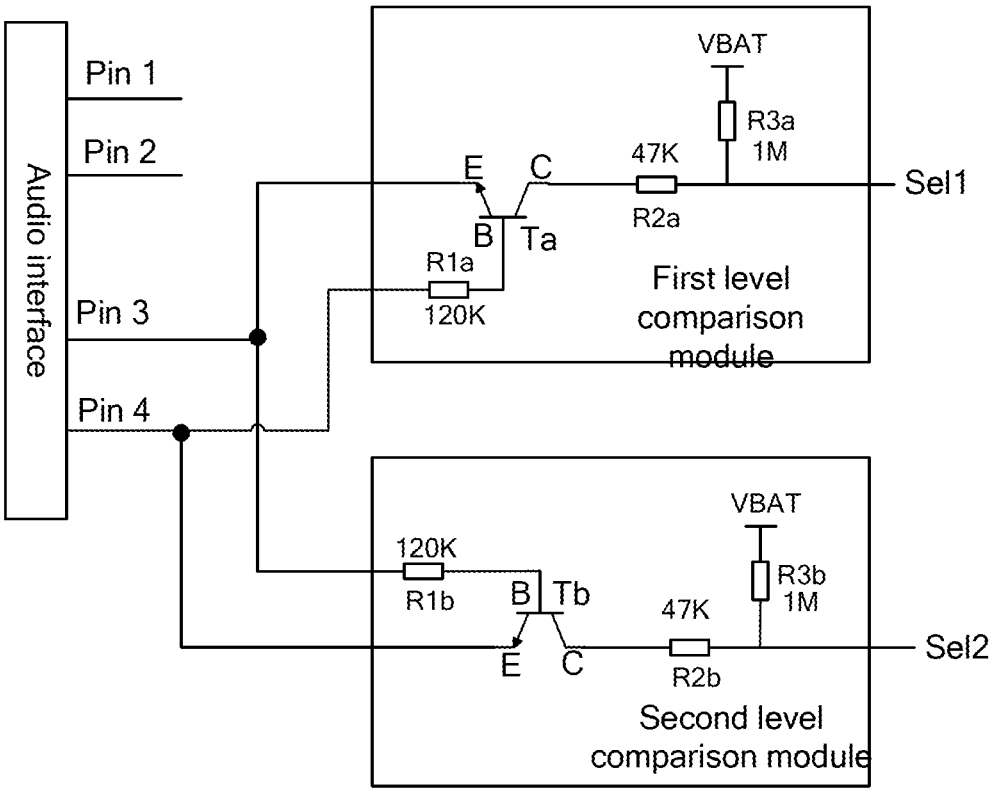
FIG. 2 is a schematic diagram of an apparatus for detecting a type of an audio interface according to a first embodiment of the present disclosure.

FIG. 2 is a schematic diagram of an apparatus for detecting a type of an audio interface according to a first embodiment of the present disclosure. In this embodiment, the first level comparison module and the second level comparison module are realized by triode circuits.

As shown in FIG. 2, the apparatus for detecting the type of the audio interface according to this embodiment comprises: an audio interface, a first level comparison module and a second level comparison module.

The audio interface comprises: audio pins (such as, a pin 1, a pin 2), a pin 3 and a pin 4. The pin 1 and the pin 2, which are audio pins, may be a left-channel pin and a right-channel pin respectively. According to different audio interface criterions, the pin 3 and the pin 4 may be used as a MIC pin and a GND pin respectively, or be used as the GND pin and the MIC pin respectively.

In this embodiment, the audio interface may be any four-part headphone plug or headphone socket, such as, a headphone plug or a headphone socket with a diameter of 3.5 mm or 2.5 mm.

If the audio interface is the headphone plug, the audio interface may be directly plugged into a headphone socket of an audio signal sending device (such as a smart mobile phone); and if the audio interface is the headphone socket, the audio interface may be connected with the headphone socket of the smart mobile phone via a adapter cable with headphone plugs at both ends.

The first level comparison module comprises: an NPN-type triode Ta, a power output end (VBAT), and a resistor R3*a*. Moreover, the first level comparison module may further comprise a resistor R1*a* and a resistor R2*a*.

If an ordinary battery is used as a power supply, a voltage outputted from the power output end is usually 2.7V-4.2V.

A resistance of the resistor R3*a* may be 100 KΩ-1 MΩ.

A resistance of the resistor R2*a* may be 1/10 to 1/5 of that of the resistor R3*a*.

A resistance of the resistor R1*a* may be 1 KΩ-200 KΩ.

A base (B) of the triode Ta is connected with the pin 4, an emitter (E) of the triode Ta is connected with the pin 3, and a collector (C) of the triode Ta is connected with an output end (Sel1) of the first level comparison module and connected with the power output end (VBAT) via the resistor R3*a*.

In the first level comparison module, the pin 4 may be connected with the base (B) of the triode Ta via the resistor R1*a*, the output end (Sel1) may be connected with the collector (C) of the triode Ta via the resistor R2*a*, and the collector (C) of the triode Ta may be connected with the power output end (VBAT) via the resistor R2*a* and the resistor R3*a* sequentially.

The second level comparison module comprises: an NPN-type triode Tb, a power output end (VBAT), and a resistor R3*b*. Moreover, the second level comparison module may further comprise a resistor R1*b* and a resistor R2*b*.

If an ordinary battery is used as a power supply, a voltage outputted from the power output end is usually 2.7V-4.2V.

A resistance of the resistor R3*b* may be 100 KΩ-1 MΩ.

A resistance of the resistor R2*b* may be 1/10 to 1/5 of that of the resistor R3*b*.

A resistance of the resistor R1*b* may be 1 KΩ-200 KΩ.

A base (B) of the triode Tb is connected with the pin 3, an emitter (E) of the triode Tb is connected with the pin 4, and a collector (C) of the triode Tb is connected with an output end (Sel2) of the second level comparison module and connected with the power output end (VBAT) via the resistor R3*b*.

In the second level comparison module, the pin 3 may be connected with the base (B) of the triode Tb via the resistor R1*b*, the output end (Sel2) may be connected with the collector (C) of the triode Tb via the resistor R2*b*, and the collector (C) of the triode Tb may be connected with the power output end (VBAT) via the resistor R2*b* and the resistor R3*b* sequentially.

In this embodiment, when the triode Ta is in an OFF-state, the power output end (VBAT) of the first level comparison module is connected with the output end (Sel1) via the resistor R3*a* and the first level comparison module outputs a high level signal via the output end (Sel1); when the triode Tb is in an OFF-state, the power output end (VBAT) of the second level comparison module is connected with the output end (Sel2) via the resistor R3*b* and the second level comparison module outputs a high level signal via the output end (Sel2).

When a level V3 of the pin 3 is greater than a sum of a level V4 of the pin 4 and a threshold Vg (i.e., V3>V4+Vg), the triode Tb of the second level comparison module is in an ON-state, the output end (Sel2) outputs a low level signal (the indication signal denoted as Sg1), indicating that the pin 3 is the MIC pin and the pin 4 is the GND pin; otherwise, the second level comparison module outputs a high level signal (denoted as Sg1').

When the level V4 of the pin 4 is greater than a sum of the level V3 of the pin 3 and the threshold Vg (i.e., V4>V3+Vg), the triode Ta of the first level comparison module is in an on state, the output end (Sel1) outputs a low level signal (the indication signal denoted as Sg2), indicating that the pin 4 is the MIC pin and the pin 3 is the GND pin; otherwise, the first level comparison module outputs a high level signal (denoted as Sg2').

In this embodiment, the threshold Vg may be a turn-on voltage of the triode Ta, such as 0.3V or 0.7V.

The "high level signal" above and hereinafter refers to a signal having a level higher than that of the "low level signal". Usually, the "low level signal" represents a signal with a voltage lower than 0.7V, and the "high level signal" represents a signal with a voltage higher than or equal to 0.7 times of that of the power supply.

Second Embodiment

Figure 3:
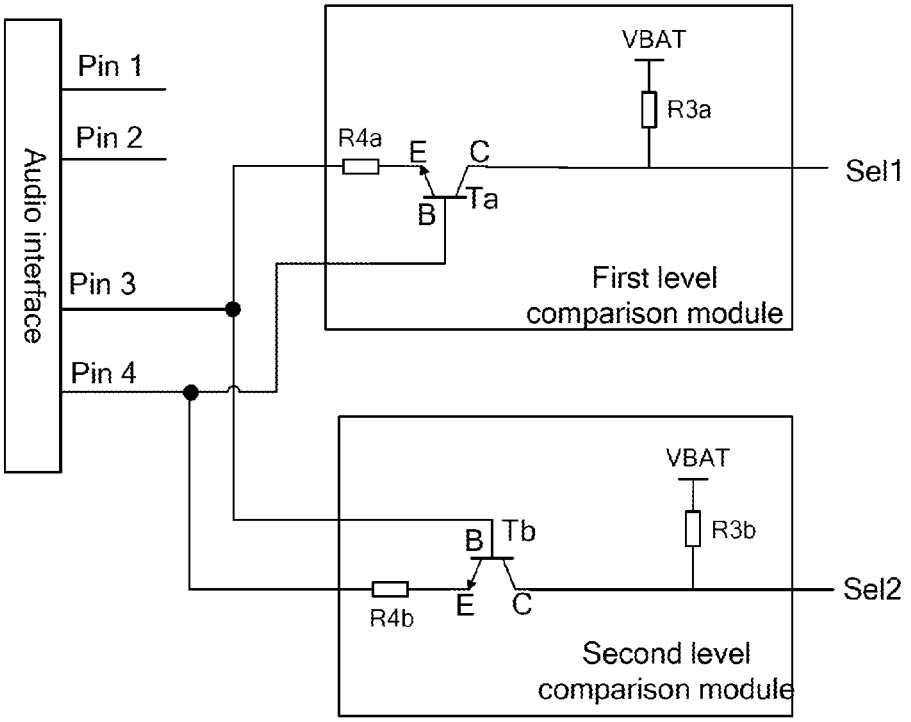
FIG. 3 is a schematic diagram of an apparatus for detecting a type of an audio interface according to a second embodiment of the present disclosure.

FIG. 3 is a schematic diagram of an apparatus for detecting a type of an audio interface according to a second embodiment of the present disclosure. In this embodiment, the first level comparison module and the second level comparison module are realized by triode circuits.

As shown in FIG. 3, the differences between this embodiment and the first embodiment are as follows.

(1) In the first level comparison module, the pin 4 and the base (B) of the triode Ta are connected directly rather than via the resistor R1*a*, the output end (Sel1) and the collector (C) of the triode Ta are connected directly rather than via the resistor R2*a*, and the pin 3 and the emitter (E) of the triode Ta are connected via a resistor R4*a*. A resistance of the resistor R4*a* may be 1 KΩ-200 KΩ.

(2) In the second level comparison module, the pin 3 and the base (B) of the triode Tb are connected directly rather than via the resistor R1*b*, the output end (Sel2) and the collector (C) of the triode Tb are connected directly rather than via the resistor R2*b*, and the pin 4 and the emitter (E) of the triode Tb are connected via a resistor R4*b*. A resistance of the resistor R4*b* may be 1 KΩ-200 KΩ.

As a variant of this embodiment, the resistors R1*a*, R2*a* and R4*a* above may also be provided in the first level comparison module; and similarly, the resistors R1*b*, R2*b* and R4*b* above may also be provided in the second level comparison module.

Third Embodiment

Figure 4:
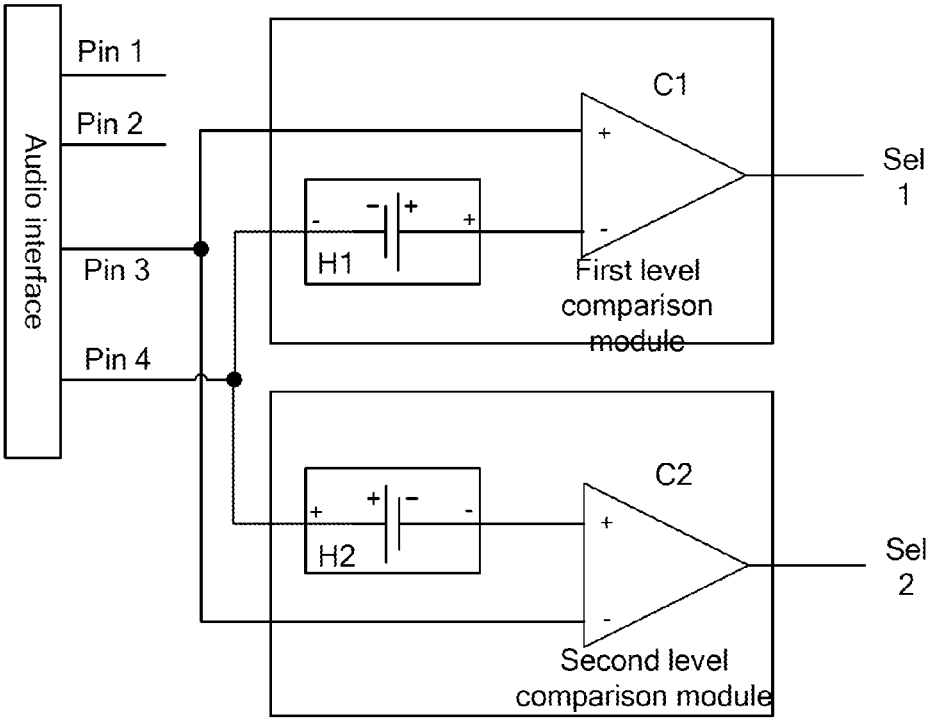
FIG. 4 is a schematic diagram of an apparatus for detecting a type of an audio interface according to a third embodiment of the present disclosure.

FIG. 4 is a schematic diagram of an apparatus for detecting a type of an audio interface according to a third embodiment of the present disclosure. In this embodiment, the first level comparison module and the second level comparison module are realized by comparator circuits.

As shown in FIG. 4, the apparatus for detecting the type of the audio interface according to this embodiment comprises: an audio interface, a first level comparison module and a second level comparison module.

The audio interface comprises: a pin 1, a pin 2, a pin 3 and a pin 4. The pin 1 and the pin 2, which are audio pins, may be a left-channel pin and a right-channel pin respectively. According to different audio interface criterions, the pin 3 and the pin 4 may be used as a MIC pin and a GND pin respectively, or be used as the GND pin and the MIC pin respectively.

The first level comparison module comprises: a first reference voltage module H1 and a comparator C1.

The pin 3 is connected with a positive terminal of the comparator C1, the pin 4 is connected with a negative terminal of the comparator C1 via the first reference voltage module H1, that is, the pin 4 is connected with a negative terminal of the first reference voltage module H1, and a positive terminal of the first reference voltage module H1 is connected with the negative terminal of the comparator C1.

In this embodiment, the first reference voltage module H1 may be a first power supply, a positive electrode of the first power supply is the positive terminal of the first reference voltage module H1, a negative electrode of the first power supply is the negative terminal of the first reference voltage module H1. A voltage supplied by the first reference voltage module H1 is a threshold Vg.

In other embodiments of the present disclosure, the first reference voltage module H1 may be an element providing a reference voltage (i.e., a threshold voltage), such as a diode connected with the first power supply.

An output pin of the comparator C1 is an output end (Sel1) of the first level comparison module.

The second level comparison module comprises: a second reference voltage module H2 and a comparator C2.

The pin 3 is connected with a negative terminal of the comparator C2, the pin 4 is connected with a positive terminal of the comparator C2 via the second reference voltage module H2, that is, the pin 4 is connected with a positive terminal of the second reference voltage module H2, and a negative terminal of the second reference voltage module H2 is connected with the positive terminal of the comparator C2.

In this embodiment, the second reference voltage module H2 may be a second power supply, a positive electrode of the second power supply is the positive terminal of the second reference voltage module H2, a negative electrode of the second power supply is the negative terminal of the second reference voltage module H2. A voltage supplied by the second reference voltage module H2 is the threshold Vg.

In other embodiments of the present disclosure, the second reference voltage module H2 may be an element providing a reference voltage (i.e., a threshold voltage), such as a diode connected with the second power supply.

In this embodiment, when a level V3 of the pin 3 is greater than a sum of a level V4 of the pin 4 and the threshold Vg (i.e., V3>V4+Vg), the output end (Sel1) of the comparator C1 of the first level comparison module outputs a high level signal (the indication signal denoted as Sg1), indicating that the pin 3 is the MIC pin and the pin 4 is the GND pin; otherwise, the first level comparison module outputs a low level signal (denoted as Sg1').

In this embodiment, when the level V4 of the pin 4 is greater than a sum of the level V3 of the pin 3 and the threshold Vg (i.e., V4>V3+Vg), an output end (Sel2) of the comparator C2 of the second level comparison module outputs a high level signal (the indication signal denoted as Sg2), indicating that the pin 4 is the MIC pin and the pin 3 is the GND pin; otherwise, the second level comparison module outputs a low level signal (denoted as Sg2').

Fourth Embodiment

Figure 5:
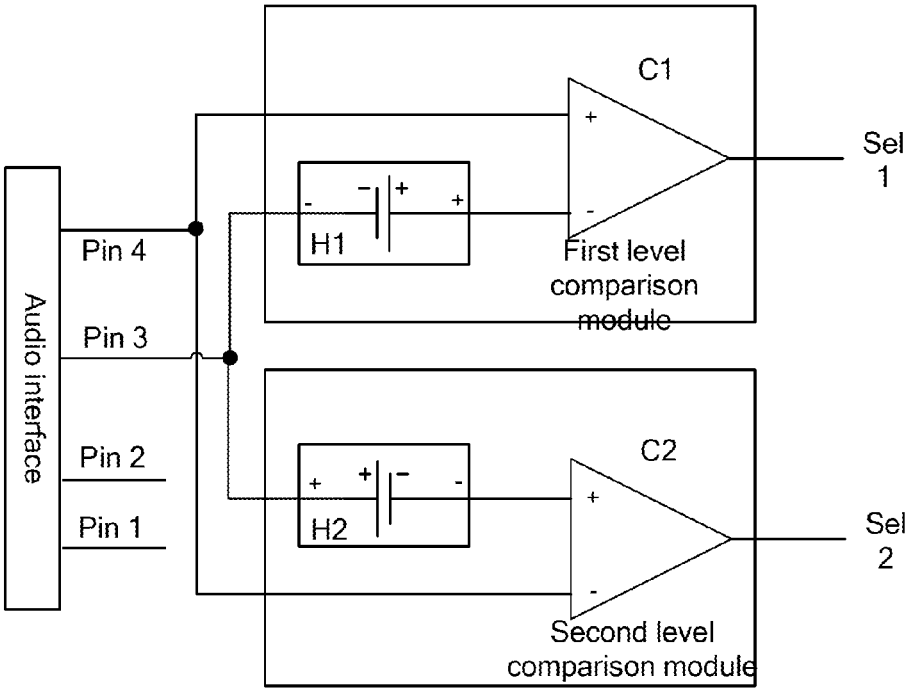
FIG. 5 is a schematic diagram of an apparatus for detecting a type of an audio interface according to a fourth embodiment of the present disclosure.

FIG. 5 is a schematic diagram of an apparatus for detecting a type of an audio interface according to a fourth embodiment of the present disclosure. In this embodiment, the first level comparison module and the second level comparison module are realized by comparator circuits.

As shown in FIG. 5, the differences between this embodiment and the third embodiment are as follows.

The pin 4 is connected with the positive terminal of the comparator C1, the pin 3 is connected with the negative terminal of the comparator C1 via the first reference voltage module H1, that is, the pin 3 is connected with the negative terminal of the first reference voltage module H1, and the positive terminal of the first reference voltage module H1 is connected with the negative terminal of the comparator C1;

the pin 4 is connected with the negative terminal of the comparator C2, the pin 3 is connected with the positive terminal of the comparator C2 via the second reference voltage module H2, that is, the pin 3 is connected with the positive terminal of the second reference voltage module H2, and the negative terminal of the second reference voltage module H2 is connected with the positive terminal of the comparator C2.

In this embodiment, when the level V3 of the pin 3 is greater than the sum of the level V4 of the pin 4 and the threshold Vg (i.e., V3>V4+Vg), the output end (Sel2) of the comparator C2 of the second level comparison module outputs a high level signal (the indication signal denoted as Sg1), indicating that the pin 3 is the MIC pin and the pin 4 is the GND pin; otherwise, the second level comparison module outputs a low level signal (denoted as Sg1').

In this embodiment, when the level V4 of the pin 4 is greater than the sum of the level V3 of the pin 3 and the threshold Vg (i.e., V4>V3+Vg), the output end (Sel1) of the comparator C1 of the first level comparison module outputs a high level signal (the indication signal denoted as Sg2), indicating that the pin 4 is the MIC pin and the pin 3 is the GND pin; otherwise, the first level comparison module outputs a low level signal (denoted as Sg2').

Fifth Embodiment

Figure 6:
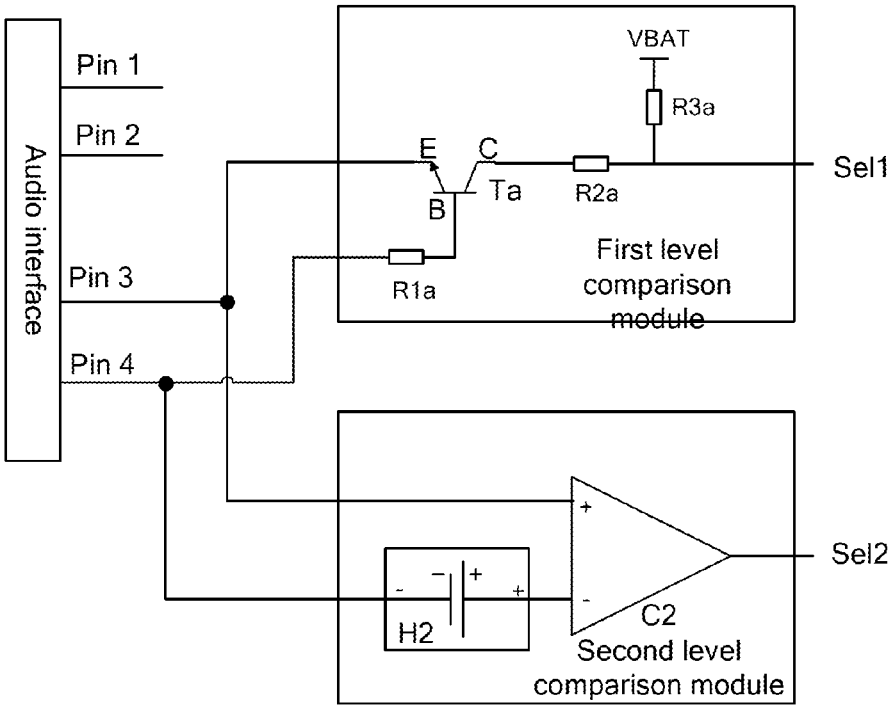
FIG. 6 is a schematic diagram of an apparatus for detecting a type of an audio interface according to a fifth embodiment of the present disclosure.

FIG. 6 is a schematic diagram of an apparatus for detecting a type of an audio interface according to a fifth embodiment of the present disclosure. In this embodiment, the first level comparison module is realized by a triode circuit and the second level comparison module is realized by a comparator circuit.

As shown in FIG. 6, the apparatus for detecting the type of the audio interface according to this embodiment comprises: an audio interface, a first level comparison module and a second level comparison module.

The audio interface comprises: a pin 1, a pin 2, a pin 3 and a pin 4. The pin 1 and the pin 2, which are audio pins, may be a left-channel pin and a right-channel pin respectively. According to different audio interface criterions, the pin 3 and the pin 4 may be used as a MIC pin and a GND pin respectively, or be used as the GND pin and the MIC pin respectively.

The first level comparison module comprises: an NPN-type triode Ta, a power output end (VBAT), and a resistor R3*a*. Moreover, the first level comparison module may further comprise a resistor R1*a* and a resistor R2*a*.

A base (B) of the triode Ta is connected with the pin 4, an emitter (E) of the triode Ta is connected with the pin 3, and a collector (C) of the triode Ta is connected with an output end (Sel1) of the first level comparison module and connected with the power output end (VBAT) via the resistor R3*a*.

In the first level comparison module, the pin 4 may be connected with the base (B) of the triode Ta via the resistor R1*a*, the output end (Sel1) may be connected with the collector (C) of the triode Ta via the resistor R2*a*, and the collector (C) of the triode Ta is connected with the power output end (VBAT) via the resistor R2*a* and the resistor R3*a*.

Certainly, the first level comparison module in this embodiment may be replaced by the first level comparison module in the second embodiment.

The second level comparison module comprises: a second reference voltage module H2 and a comparator C2.

The pin 3 is connected with a positive terminal of the comparator C2, the pin 4 is connected with a negative terminal of the comparator C2 via the second reference voltage module H2, that is, the pin 4 is connected with a negative terminal of the second reference voltage module H2, and a positive terminal of the second reference voltage module H2 is connected with the negative terminal of the comparator C2.

In this embodiment, the second reference voltage module H2 may be a power supply, a positive electrode of the power supply is the positive terminal of the second reference voltage module H2, a negative electrode of the power supply is the negative terminal of the second reference voltage module H2. The voltage supplied by the second reference voltage module H2 is a threshold Vg.

In other embodiments of the present disclosure, the second reference voltage module H2 may be an element providing a reference voltage (i.e., a threshold voltage), such as a diode connected with the power supply.

An output pin of the comparator C2 is an output end (Sel2) of the second level comparison module.

In this embodiment, when a level V3 of the pin 3 is greater than a sum of a level V4 of the pin 4 and the threshold Vg (i.e., V3>V4+Vg), the output end (Sel2) of the comparator C2 of the second level comparison module outputs a high level signal (the indication signal denoted as Sg1), indicating that the pin 3 is the MIC pin and the pin 4 is the GND pin; otherwise, the second level comparison module outputs a low level signal (denoted as Sg1').

In this embodiment, when the level V4 of the pin 4 is greater than a sum of the level V3 of the pin 3 and the threshold Vg (i.e., V4>V3+Vg), the triode Ta of the first level comparison module is in an ON-state, the output end (Sel1) outputs a low level signal (the indication signal denoted as Sg2), indicating that the pin 4 is the MIC pin and the pin 3 is the GND pin; otherwise, the first level comparison module outputs a high level signal (denoted as Sg2').

In this embodiment, a turn-on voltage of the triode Ta may be the threshold Vg, such as 0.3V or 0.7V.

Sixth Embodiment

Figure 7:
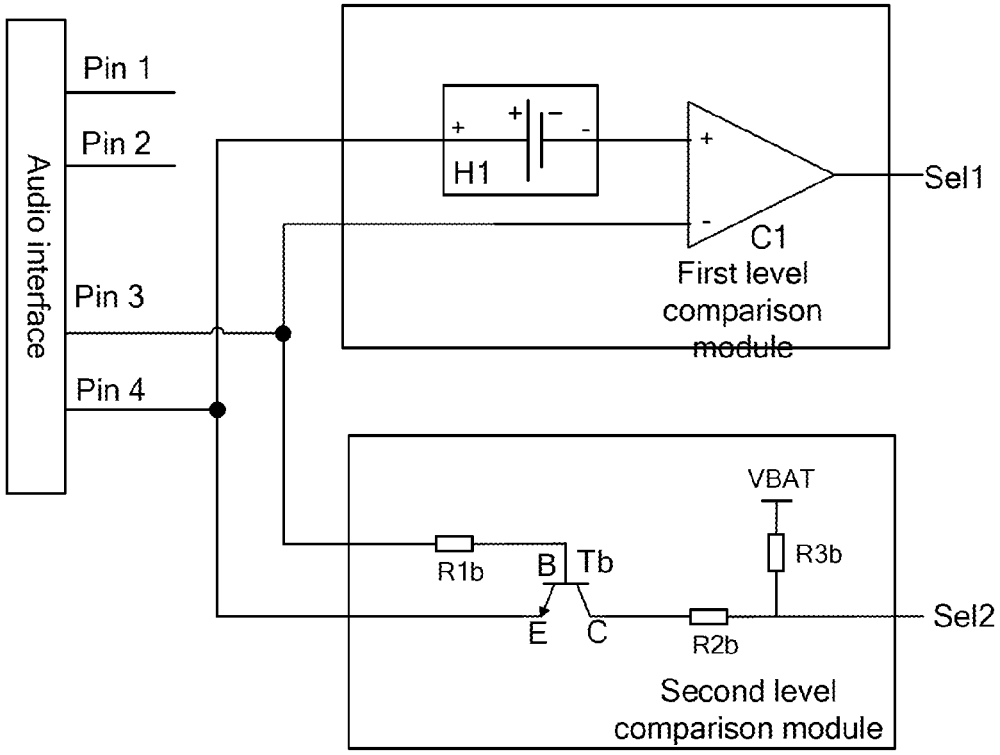
FIG. 7 is a schematic diagram of an apparatus for detecting a type of an audio interface according to a sixth embodiment of the present disclosure.

FIG. 7 is a schematic diagram of an apparatus for detecting a type of an audio interface according to a sixth embodiment of the present disclosure. In this embodiment, the first level comparison module is realized by a comparator circuit and the second level comparison module is realized by a triode circuit.

The first level comparison module comprises: a first reference voltage module H1 and a comparator C1.

The pin 3 is connected with a negative terminal of the comparator C1, the pin 4 is connected with a positive terminal of the comparator C1 via the first reference voltage module H1, that is, the pin 4 is connected with a positive terminal of the first reference voltage module H1, and a negative terminal of the first reference voltage module H1 is connected with the positive terminal of the comparator C1.

In this embodiment, the first reference voltage module H1 may be a power supply, a positive electrode of the power supply is the positive terminal of the first reference voltage module H1, a negative electrode of the power supply is the negative terminal of the first reference voltage module H1. The voltage supplied by the first reference voltage module H1 may be a threshold Vg.

In other embodiments of the present disclosure, the first reference voltage module H1 may be an element providing a reference voltage (i.e., a threshold voltage), such as a diode connected with the power supply.

The second level comparison module comprises: an NPN-type triode Tb, a power output end (VBAT), and a resistor R3*b*. Moreover, the second level comparison module may further comprise a resistor R1*b* and a resistor R2*b*.

A base (B) of the triode Tb is connected with the pin 3, an emitter (E) of the triode Tb is connected with the pin 4, and a collector (C) of the triode Tb is connected with an output end (Sel2) of the second level comparison module and connected with the power output end (VBAT) via the resistor R3*b*.

In the second level comparison module, the pin 3 may be connected with the base (B) of the triode Tb via the resistor R1*b*, the output end (Sel2) may be connected with the collector (C) of the triode Tb via the resistor R2*b*, and the collector (C) of the triode Tb may be connected with the power output end (VBAT) via the resistor R2*b* and the resistor R3*b* sequentially.

In this embodiment, the threshold Vg may be a turn-on voltage of the triode Ta, such as 0.3V or 0.7V.

Certainly, the second level comparison module in this embodiment may be replaced by the second level comparison module in the second embodiment.

In this embodiment, when a level V3 of the pin 3 is greater than a sum of a level V4 of the pin 4 and the threshold Vg (i.e., V3>V4+Vg), the triode Tb of the second level comparison module is in an ON-state, the output end (Sel2) outputs a low level signal (the indication signal denoted as Sg1), indicating that the pin 3 is the MIC pin and the pin 4 is the GND pin; otherwise, the second level comparison module outputs a high level signal (denoted as Sg1').

In this embodiment, when the level V4 of the pin 4 is greater than a sum of the level V3 of the pin 3 and the threshold Vg (i.e., V4>V3+Vg), the output end (Sel1) of the comparator C1 of the first level comparison module outputs a high level signal (the indication signal denoted as Sg2), indicating that the pin 4 is the MIC pin and the pin 3 is the GND pin; otherwise, the first level comparison module outputs a low level signal (denoted as Sg2').

Based on the principle of the present disclosure, various modifications to above embodiments may also be made. For example, in above embodiments, the thresholds Vg for judging a voltage difference between the pin 3 and the pin 4 in the first level comparison module and in the second level comparison module are identical. In other embodiments, the thresholds Vg for judging the voltage difference between the pin 3 and the pin 4 in the first level comparison module and in the second level comparison module may be different, denoted as Vg1 and Vg2, where both Vg1 and Vg2 are greater than or equal to 0.

With the apparatus for detecting the type of the audio interface according to embodiments of the present disclosure, two level comparison modules (denoted as a first level comparison module and a second level comparison module) are provided herein, the first level comparison module sends a signal Sg1 if the level of the pin 3 is greater than that of the pin 4 by a certain amplitude, otherwise sends a signal Sg1', and the second level comparison module sends a signal Sg2 if the level of the pin 4 is greater than that of the pin 3 by a certain amplitude, otherwise sends a signal Sg2'. In other words, three cases may be provided by the apparatus for detecting the type of the audio interface according to embodiments of the present disclosure.

Case 1: the first level comparison module sends the signal Sg1 (indicating V3>V4+Vg1), the second level comparison module sends the signal Sg2' (indicating V4≤V3+Vg2); that is, the pin 3 is the MIC pin.

Case 2: the first level comparison module sends the signal Sg1' (indicating V3≤V4+Vg1), the second level comparison module sends the signal Sg2 (indicating V4>V3+Vg2); that is, the pin 4 is the MIC pin.

Case 3: the first level comparison module sends the signal Sg1' (indicating V3≤V4+Vg1), the second level comparison module sends the signal Sg2' (indicating V4≤V3+Vg2); that is, the types of the pin 3 and the pin 4 are unknown.

Therefore, the apparatus for detecting the type of the audio interface according to embodiments of the present disclosure may accurately detect the type of the audio interface connected with the apparatus with a low cost. Provided that in the audio device provided with the apparatus for detecting the type of the audio interface, the audio pins (the pin 1 and the pin 2) of the audio interface are correctly connected with the GND pin (i.e., one of the pin 3 and the pin 4) according to the signal output from the apparatus, the audio signal output from the audio device with any audio interface type may be correctly received. Moreover, the MIC pin of the pin 3 and the pin 4 may be used to send an audio signal to the audio device.

Although explanatory embodiments have been shown and described above, they are not construed to limit the present invention. Any changes, alternatives, and modifications made within the technical scope of the present disclosure by those skilled in the art should be included within the protection scope of the present disclosure which is defined by the protection scope of the claims.

What is claimed is:

1. An apparatus for detecting a type of an audio interface, comprising:

an audio interface, comprising a pin 3 and a pin 4, wherein one of the pin 3 and the pin 4 is configured as a MIC pin of the audio interface, and the other one is configured as a ground pin;

a first level comparison module, connected with the pin 3 and the pin 4, and configured to output a signal Sg1 via an output end of the first level comparison module, when a level V3 of the pin 3 is greater than a sum of a level V4 of the pin 4 and a predetermined threshold Vg1, otherwise to output a signal Sg1' via the output end of the first level comparison module;

a second level comparison module, connected with the pin 3 and the pin 4, and configured to output a signal Sg2 via an output end of the second level comparison module, when the level V4 of the pin is greater than a sum of the level V3 of the pin 3 and a predetermined threshold Vg2, otherwise to output a signal Sg2' via the output end of the second level comparison module;

wherein the signal Sg1 is different from the signal Sg1', the signal Sg2 is different from the signal Sg2', and the predetermined threshold Vg1 and the predetermined threshold Vg2 are greater than or equal to 0.

2. The apparatus according to claim 1, wherein the signal Sg1 is a high level signal, the signal Sg1' is a low level signal; or the signal Sg1 is a low level signal, the signal Sg1' is a high level signal; and the signal Sg2 is a high level signal, the signal Sg2' is a low level signal; or the signal Sg2 is a low level signal, the signal Sg2' is a high level signal.

3. The apparatus according to claim 1, wherein the first level comparison module comprises: an NPN-type triode Ta and an output end of a first power supply;

a base of the NPN-type triode Ta is connected with the pin 4, an emitter of the NPN-type triode Ta is connected with the pin 3, and a collector of the NPN-type triode Ta is connected with the output end of the first level comparison module and the output end of the first power supply;

the second level comparison module comprises: an NPN-type triode Tb and an output end of a second power supply;

a base of the NPN-type triode Tb is connected with the pin 3, an emitter of the NPN-type triode Tb is connected with the pin 4, and a collector of the NPN-type triode Tb is connected with the output end of the second level comparison module and the output end of the second power supply.

4. The apparatus according to claim 1, wherein the first level comparison module comprises: a first reference voltage module H1 and a comparator C1;

the pin 3 is connected with a positive terminal of the comparator C1, the pin 4 is connected with a negative terminal of the first reference voltage module H1, and a positive terminal of the first reference voltage module H1 is connected with a negative terminal of the comparator C1;

the second level comparison module comprises: a second reference voltage module H2 and a comparator C2;

the pin 3 is connected with a negative terminal of the comparator C2, the pin 4 is connected with a positive terminal of the second reference voltage module H2, and a negative terminal of the second reference voltage module H2 is connected with a positive terminal of the comparator C2.

5. The apparatus according to claim 1, wherein the first level comparison module comprises: a first reference voltage module H1 and a comparator C1;

the pin 4 is connected with a positive terminal of the comparator C1, the pin 3 is connected with a negative terminal of the first reference voltage module H1, and a positive terminal of the first reference voltage module H1 is connected with a negative terminal of the comparator C1;

the second level comparison module comprises: a second reference voltage module H2 and a comparator C2;

the pin 4 is connected with a negative terminal of the comparator C2, the pin 3 is connected with a positive terminal of the second reference voltage module H2, and a negative terminal of the second reference voltage module H2 is connected with a positive terminal of the comparator C2.

6. The apparatus according to claim 1, wherein the first level comparison module comprises: an NPN-type triode Ta and an output end of the first power supply;

a base of the NPN-type triode Ta is connected with the pin 4, an emitter of the NPN-type triode Ta is connected with the pin 3, and a collector of the NPN-type triode Ta is connected with the output end of the first level comparison module and the output end of the first power supply;

the second level comparison module comprises: a second reference voltage module H2 and a comparator C2;

the pin 3 is connected with a positive terminal of the comparator C2, the pin 4 is connected with a negative terminal of the second reference voltage module H2, and a positive terminal of the second reference voltage module H2 is connected with a negative terminal of the comparator C2.

7. The apparatus according to claim 1, wherein the first level comparison module comprises: a first reference voltage module H1 and a comparator C1;

the pin 3 is connected with a negative terminal of the comparator C1, the pin 4 is connected with a positive terminal of the first reference voltage module H1, and a negative terminal of the first reference voltage module H1 is connected with a positive terminal of the comparator C1;

the second level comparison module comprises: an NPN-type triode Tb and an output end of the second power supply;

a base of the NPN-type triode Tb is connected with the pin 3, an emitter of the NPN-type triode Tb is connected with the pin 4, and a collector of the NPN-type triode Tb is connected with the output end of the second level comparison module and the output end of the second power supply.

8. The apparatus according to claim 3, further comprising a resistor R3*a*, wherein the output end of the first power supply is connected with the collector of the NPN-type triode Ta and the output end of the first level comparison module via the resistor R3*a*.

9. The apparatus according to claim 8, further comprising:

a resistor R1*a*and a resistor R2*a*, wherein the pin 4 is connected with the base of the NPN-type triode Ta via the resistor R1*a*, the output end of the first level comparison module is connected with the collector of the NPN-type triode Ta via the resistor R2*a*, the collector of the NPN-type triode Ta is connected with the output end of the first power supply via the resistor R2*a*and the resistor R3*a* sequentially; and/or a resistor R4*a*, wherein the pin 3 is connected with the emitter of the NPN-type triode Ta via the resistor R4*a*.

10. The apparatus according to claim 3, further comprising a resistor R3*b*, wherein the output end of the second power supply is connected with the collector of the NPN-type triode Tb and the output end of the second level comparison module via the resistor R3*b*.

11. The apparatus according to claim 10, further comprising:

a resistor R1*b*and a resistor R2*b*, wherein the pin 3 is connected with the base of the NPN-type triode Tb via the resistor R1*b*,the output end of the second level comparison module is connected with the collector of the NPN-type triode Tb via the resistor R2*b*, the collector of the NPN-type triode Tb is connected with the output end of the second power supply via the resistor R2*b*and the resistor R3*b* sequentially; and/or a resistor R4*b*, wherein the pin 4 is connected with the emitter of the NPN-type triode Tb via the resistor R4b.

12. The apparatus according to claim 1, wherein the audio interface is a headphone jack or a headphone socket.

13. The apparatus according to claim 2, wherein the first level comparison module comprises: an NPN-type triode Ta and a output end of a first power supply;

a base of the NPN-type triode Ta is connected with the pin 4, an emitter of the NPN-type triode Ta is connected with the pin 3, and a collector of the NPN-type triode Ta is connected with the output end of the first level comparison module and the output end of the first power supply;

the second level comparison module comprises: an NPN-type triode Tb and a output end of a second power supply;

a base of the NPN-type triode Tb is connected with the pin 3, an emitter of the NPN-type triode Tb is connected with the pin 4, and a collector of the NPN-type triode Tb is connected with the output end of the second level comparison module and the output end of the second power supply.

14. The apparatus according to claim 2, wherein the first level comparison module comprises: a first reference voltage module H1 and a comparator C1;

the pin 3 is connected with a positive terminal of the comparator C1, the pin 4 is connected with a negative terminal of the first reference voltage module H1, and a positive terminal of the first reference voltage module H1 is connected with a negative terminal of the comparator C1;

the second level comparison module comprises: a second reference voltage module H2 and a comparator C2;

the pin 3 is connected with a negative terminal of the comparator C2, the pin 4 is connected with a positive terminal of the second reference voltage module H2, and a negative terminal of the second reference voltage module H2 is connected with a positive terminal of the comparator C2.

15. The apparatus according to claim 2, wherein the first level comparison module comprises: a first reference voltage module H1 and a comparator C1;

the pin 4 is connected with a positive terminal of the comparator C1, the pin 3 is connected with a negative terminal of the first reference voltage module H1, and a positive terminal of the first reference voltage module H1 is connected with a negative terminal of the comparator C1;

the second level comparison module comprises: a second reference voltage module H2 and a comparator C2;

the pin 4 is connected with a negative terminal of the comparator C2, the pin 3 is connected with a positive terminal of the second reference voltage module H2, and a negative terminal of the second reference voltage module H2 is connected with a positive terminal of the comparator C2.

16. The apparatus according to claim 2, wherein the first level comparison module comprises: an NPN-type triode Ta and an output end of the first power supply;

a base of the NPN-type triode Ta is connected with the pin 4, an emitter of the NPN-type triode Ta is connected with the pin 3, and a collector of the NPN-type triode Ta is connected with the output end of the first level comparison module and the output end of the first power supply;

the second level comparison module comprises: a second reference voltage module H2 and a comparator C2;

the pin 3 is connected with a positive terminal of the comparator C2, the pin 4 is connected with a negative terminal of the second reference voltage module H2, and a positive terminal of the second reference voltage module H2 is connected with a negative terminal of the comparator C2.

17. The apparatus according to claim 2, wherein the first level comparison module comprises: a first reference voltage module H1 and a comparator C1;

the pin 3 is connected with a negative terminal of the comparator C1, the pin 4 is connected with a positive terminal of the first reference voltage module H1, and a negative terminal of the first reference voltage module H1 is connected with a positive terminal of the comparator C1;

the second level comparison module comprises: an NPN-type triode Tb and an output end of the second power supply;

a base of the NPN-type triode Tb is connected with the pin 3, an emitter of the NPN-type triode Tb is connected with the pin 4, and a collector of the NPN-type triode Tb is connected with the output end of the second level comparison module and the output end of the second power supply.

18. The apparatus according to claim 6, further comprising a resistor R3a, wherein the output end of the first power supply is connected with the collector of the NPN-type triode Ta and the output end of the first power supply via the resistor R3*a*.

19. The apparatus according to claim 7, further comprising a resistor R3*b*, wherein the output end of the second power supply is connected with the collector of the NPN-type triode Tb and the output end of the second power supply via the resistor R3*b*.

20. The apparatus according to claim 18, further comprising:

a resistor R1*a* and a resistor R2*a*, wherein the pin 4 is connected with the base of the NPN-type triode Ta via the resistor R1*a*, the output end of the first level comparison module is connected with the collector of the NPN-type triode Ta via the resistor R2*a*, the collector of the NPN-type triode Ta is connected with the output end of the first power supply via the resistor R2*a* and the resistor R3*a*sequentially; and/or a resistor R4*a*, wherein the pin 3 is connected with the emitter of the NPN-type triode Ta via the resistor R4*a*.

21. The apparatus according to claim 19, further comprising:

a resistor Rib and a resistor R2*b*, wherein the pin 3 is connected with the base of the NPN-type triode Tb via the resistor R1*b*, the output end of the second level comparison module is connected with the collector of the NPN-type triode Tb via the resistor R2*b*, the collector of the NPN-type triode Tb is connected with the output end of the second power supply via the resistor R2*b*and the resistor R3*b* sequentially; and/or a resistor R4*b*, wherein the pin 4 is connected with the emitter of the NPN-type triode TB via the resistor R4*b*.

* * * * *